US010413091B2

(12) United States Patent
Ahearn et al.

(10) Patent No.: US 10,413,091 B2
(45) Date of Patent: Sep. 17, 2019

(54) DEVICE FOR HANGING A PACKAGE FROM A DISPLAY

(71) Applicant: ALLEN FIELD COMPANY, INC., Brightwaters, NY (US)

(72) Inventors: Robert Ahearn, Massapequa, NY (US); Andrew Franzone, Jr., Bay Shore, NY (US)

(73) Assignee: ALLEN FIELD COMPANY, INC., Brightwaters, NY (US)

( * ) Notice: Subject to any disclaimer, the term of this patent is extended or adjusted under 35 U.S.C. 154(b) by 0 days.

(21) Appl. No.: 15/818,890

(22) Filed: Nov. 21, 2017

(65) Prior Publication Data

US 2019/0150637 A1 May 23, 2019

(51) Int. Cl.

| | |
|---|---|
| ***A47F 5/00*** | (2006.01) |
| ***A47F 7/28*** | (2006.01) |
| *E05B 69/00* | (2006.01) |

(52) U.S. Cl.

CPC ..... *A47F 5/0006* (2013.01); *A47F 7/28* (2013.01); *E05B 69/00* (2013.01)

(58) Field of Classification Search

CPC ..... A47F 5/00; A47F 5/0012; A47F 5/0018; A47F 5/0043; A47F 5/0006; A47F 7/0042; A47F 7/28; A47F 2005/0012; A47F 2005/0075; A47G 26/00; A47G 25/74; A47G 25/18; A47G 25/00; A46B 17/02; E05B 69/00

USPC .... 248/318, 339, 317, 309.1, 691, 692, 682, 248/690; 206/770, 349, 477; 81/177.1, 81/436, 489

See application file for complete search history.

(56) References Cited

U.S. PATENT DOCUMENTS

| | | | | |
|---|---|---|---|---|
| 2,938,252 | A * | 5/1960 | Scheemaeker | B42F 1/02 |
| 3,348,272 | A * | 10/1967 | Germani | D06F 55/00 |
| 3,352,071 | A * | 11/1967 | Sutter | E04B 9/12 |
| 4,593,441 | A * | 6/1986 | St. Louis | F16B 5/0614 |
| 4,723,749 | A * | 2/1988 | Carraro et al. | A47H 1/10 |
| 5,013,004 | A * | 5/1991 | Wilkins et al. | B65B 61/14 |
| 5,482,240 | A * | 1/1996 | Caraher | E04C 1/40 |
| 6,243,925 | B1 * | 6/2001 | Aszody | A47G 25/48 24/30.5 S |
| 8,028,451 | B1 * | 10/2011 | Lee | G09F 3/20 40/642.02 |
| 9,402,487 | B2 * | 8/2016 | Jensen | A47G 25/743 |
| 2008/0256763 | A1 * | 10/2008 | Azzopardi | A47G 25/48 24/343 |
| 2011/0024585 | A1 * | 2/2011 | Brinkdopke et al. | F16B 45/02 |
| 2016/0128493 | A1 * | 5/2016 | Brown | A47F 5/0006 248/300 |

(Continued)

*Primary Examiner* — Nkeisha Smith

(74) *Attorney, Agent, or Firm* — Epstein Drangel LLP; Robert L. Epstein

(57) ABSTRACT

The device is designed for use with a package having a header. The device includes a body having top and bottom surfaces, and front and rear edges. A hook extends from the top surface of the body and is adapted to engage the display. A front member extends downwardly from the front edge of the body. At least one rear member extends downwardly from the rear edge of the body. The front and rear members and the bottom surface of the body form a recess which is adapted to receive the header. A part engages the header between the front and rear members. The part extends from one member toward the header and includes an upwardly and inwardly inclined wall.

27 Claims, 2 Drawing Sheets

(56) References Cited

U.S. PATENT DOCUMENTS

| | | | | |
|---|---|---|---|---|
| 2016/0135630 | A1* | 5/2016 | Laatz | A47G 25/74 |
| 2017/0253408 | A1* | 8/2017 | Strassburger | B65D 79/02 |

* cited by examiner

DEVICE FOR HANGING A PACKAGE FROM A DISPLAY

BACKGROUND OF THE INVENTION

1. Field of the Invention

The present invention relates to packaging displays and more particularly to a device for hanging a package on a display.

2. Description of Prior Art Including Information Disclosed Under 37 CFR 1.97 and 1.98

Displays designed for supporting packages in a retail environment often have multiple horizontally extending rods or similar members from which packaged merchandise can be suspended. Commonly, the packages have headers with one or more openings. The header openings are adapted to accept one or more of rods from the display to suspend the packages.

While that is a simple and inexpensive way of displaying the merchandise, it is difficult for a potential purchaser to remove the package from the display by sliding the package along the rod. Further, if the potential purchaser wishes to remove a package from the rod other than the first package, all of the packages on the display ahead of the package being removed must be taken off the rod before the package of interest can be removes. Those packages then must be put back on the rod after the package has been removed.

It is therefore a prime object of the present invention to provide a device for attaching a merchandise package on a display.

It is another object of the present invention to provide a device for attaching a merchandise package on a display which can be easily mounted on the header of a merchandise package.

It is another object of the present invention to provide a device for attaching a merchandise package on a display which can be easily mounted on the header of a merchandise package by sliding the device onto the header from the side.

It is another object of the present invention to provide a device for attaching a merchandise package on a display which includes structure defining a recess adapted to receive the header.

It is another object of the present invention to provide a device for attaching a merchandise package on a display which can engage the header when received in the recess.

It is another object of the present invention to provide a device for attaching a merchandise package on a display which can be easily removed from the rod without removing other packages suspended from the rod.

It is another object of the present invention to provide a device for attaching a merchandise package on a display which is simple to use.

It is another object of the present invention to provide a device for attaching a merchandise package on a display which is inexpensive to manufacture.

BRIEF SUMMARY OF THE INVENTION

To those and such other objections which may hereinafter appear, the present invention relates to a device is provided for hanging a package of the type having a header from a display. The device includes a body having a top surface, a bottom surface, first edge and a second edge. A hook extends from the top surface of the body and is adapted to engage the display. A first member extends downwardly from the first edge of the body. A second member extends downwardly from the second edge of the body. Means are provided for engaging the header between the first member and the second member. The header engaging means includes a part extending from one of the first and second members toward the header.

The engaging means part includes an inclined wall. The inclined wall extends from the member. Preferably, the inclined wall extends upwardly and away the member.

The engaging means further also includes a side element. The side element extends between said inclined wall and the member.

The device also includes an opening in the member. The inclined wall has an edge aligned with the opening.

The hook is situated in a first plane. The first member is situated in a second plane. The second member is situated in a third plane. Preferably, the first plane is situated between the second plane and the third plane. The second plane and the third plane are substantially parallel to and spaced from each other.

In accordance with another aspect of the present invention, a device is provided for hanging a package of the type having a header from a display. The device includes a body having a top surface, a bottom surface, a first edge and a second edge. A hook extends from the top surface of the body and is adapted to engage the display. A first member extends downwardly from the first edge of the body. Second and third members extend downwardly from the second edge of the body in spaced relation. The first member is situated in a first plane. The second and third members are situated in a second plane. The first plane is spaced from and is substantially parallel to the second plane such that the header can be received therebetween.

The first member is aligned with the space between the second and the third members.

The device also includes engaging means associated with the one of the members.

The engaging means includes a part with an inclined wall. The part extends from the member surface. Preferably, the part extends upwardly and away from the member.

The device has an opening in one member. The inclined wall has an edge. The edge of the part is aligned with the opening.

In accordance with another aspect of the present invention, a package having a header is provided in combination with a device for hanging the package from a display. The device includes a body having a top surface, a bottom surface, a first edge and a second edge. A hook extends from the top surface of the body and is adapted to engage the display. A first member extends downwardly from the first edge of the body. A second member and a third member extend downwardly from the second edge of the body in spaced relation. The first member is situated in a first plane. The second member and the third member are situated in a second plane. The first plane is spaced from and substantially parallel to the second plane such that the header can be received between the second member and the third member.

BRIEF DESCRIPTION OF THE SEVERAL VIEWS OF DRAWINGS

To these and to such other objects that may hereinafter appears, the present invention relates to a device for hanging a package from a display as described in detail in the following specification and recited in the annexed claims, taken together with the accompanying drawings, in which like numerals refer to like parts and in which:

DETAILED DESCRIPTION OF THE INVENTION

Figure 1:
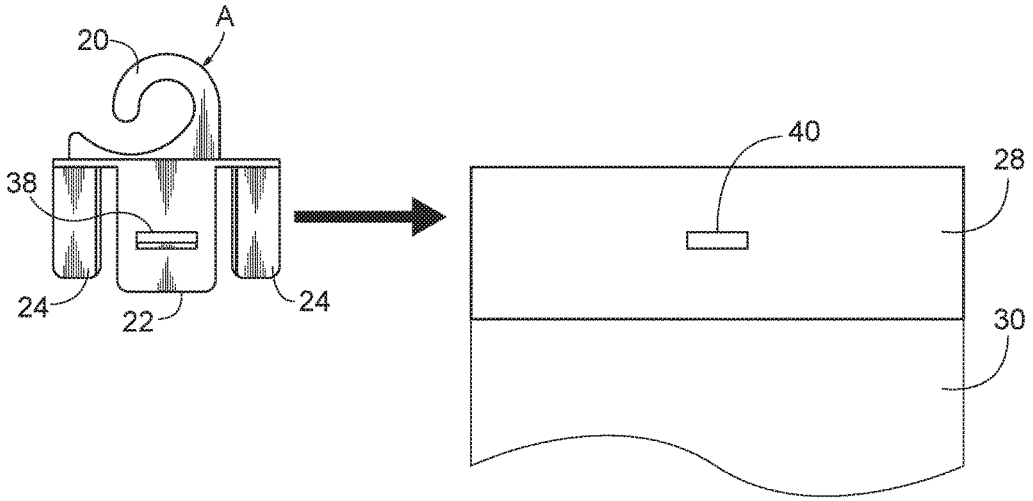
FIG. 1 is an image of the device of the present invention and the top portion of a package with a header, illustrating how the device is mounted on the package header.
Figure 2:
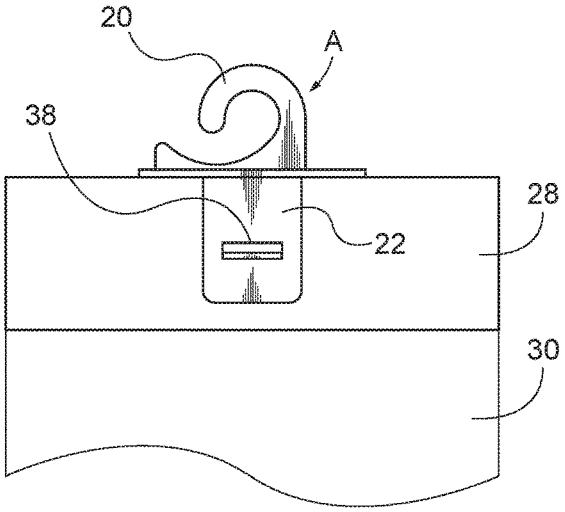
FIG. 2 is an image of the device of the present invention and the top portion of a package with a header, showing the device mounted on the header.

As illustrated in the drawings, the device of the present invention, generally designated A, includes a body 10 having a top surface 12 and a bottom surface 14. Body 10 also has a front edge 16 and a rear edge 18.

A hook 20 extends upwardly from top surface 12 of body 10. Hook 20 is adapted to engage a display (not shown) to suspend the device from the display. More particularly, hook 20 is designed to engage the rod or other horizontally extending member of the display.

First member 22 extends downwardly from the front edge 16 of the body. Preferably, member 22 is situated at a location in the middle of body 10.

Second and third members 24 extend downwardly from the rear edge 18 of the body. Preferably, members 24 are located proximate different ends of body 10 with member 22 aligned with the space between members 24.

Figure 5:
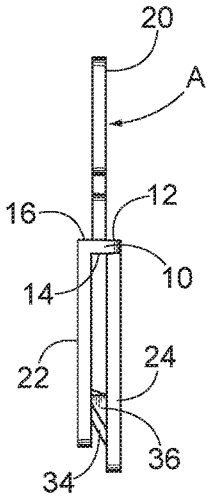
FIG. 5 is an elevation view of the left side of the device.

From FIG. 5, which shows the device from the side, it can be seen that member 22 lies in a plane which is spaced from and parallel to the plane in which members 24 lie. It can also be seen that the plane of hook 20 lies parallel to and between the planes of member 22 and members 24.

Further, in FIG. 5 it can be seen that member 2, the bottom surface 14 of body 10 and members 22 define a recess 26. Recess 26 is adapted to receive the header 28 of a package 30, as the device sides over the header, as indicated by the arrow in FIG. 1.

Means 32 are provided for engaging the package header 28 between member 22, on the one hand, and members 24, on the other hand. The header engaging means 28 takes the form of a part that includes an inclined wall 34, which extends upwardly and outwardly from the inner facing surface of the member from which it extends. The part also has triangular shaped side walls 36.

Figure 3:
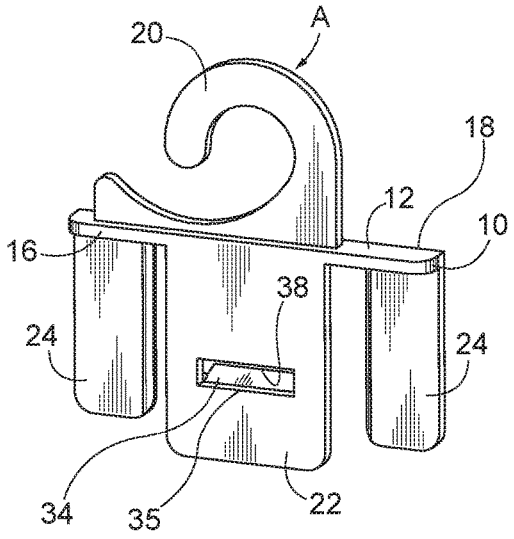
FIG. 3 is a perspective view of the device showing the front, top and left side thereof.
Figure 4:
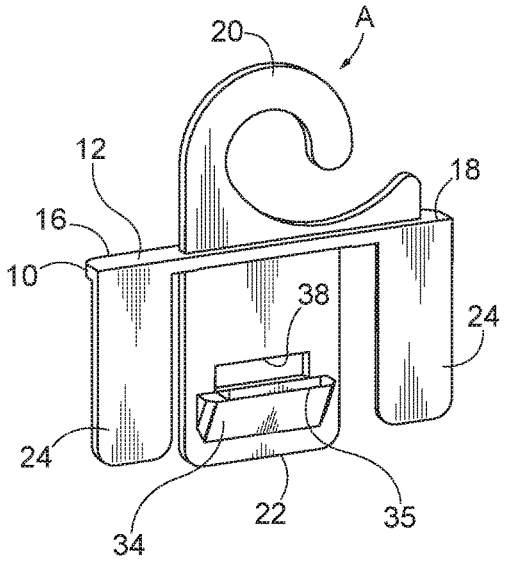
FIG. 4 is a perspective view of the device showing the rear, bottom and right side thereof.

Preferably, an opening 38 is formed in member 22. Opening 38 is aligned with the engaging means part such that the edge 35 of wall 34 is visible through the opening from the front to the device, see FIG. 3.

Preferably, the header 28 is formed with a rectangular opening 40. Wall 34 of the engaging means part is adapted to engage the header proximate the opening to secure the device on the header, as the device slides over the header. The opening 38 in member 22 allows the user to see through member 22 to the header as the device slides over the header to its proper position relative to the header.

While only a single preferred embodiment of the present invention has been disclosed for purposes of illustration, it is obvious that many modifications and variations could be made thereto. It is intended to cover all of those modifications and variations which fall within the scope of the present invention, as defined by the following claims:

We claim:

1. A device for hanging a package from a display, the package having a header, said device comprising a continuous planar body having a top surface, a bottom surface, a first edge and a second edge spaced from each other, a hook extending from said top surface of said body and adapted to engage the display, a first generally planar member extending downwardly from said first edge of said body in a first plane, a second generally planar member extending downwardly from said second edge of said body in a second plane, and further comprising a part extending from said first member toward said second plane adapted to engage said header.

2. The device of claim 1 wherein said part comprises an inclined wall.

3. The device of claim 2 wherein said inclined wall extends from said first plane toward said second plane.

4. The device of claim 2 wherein said inclined wall extends upwardly from said first member toward said second member.

5. The device of claim 2 wherein said inclined wall extends away from said first member toward said second member.

6. A device for hanging a package from a display, the package having a header, said device comprising a body having a top surface, a bottom surface, a first edge and a second edge spaced from each other, a hook extending from said top surface of said body and adapted to engage the display, a first generally planar member extending downwardly from said first edge of said body in a first plane, a second generally planar member extending downwardly from said second edge of said body in a second plane, and further comprising a part extending from said first member toward said second plane adapted to engage said header, wherein said part comprises an inclined wall, and said part further comprises a side element extending between said inclined wall and said first member.

7. The device of claim 2 wherein said inclined wall has an unattached edge and further comprising an opening in said first member aligned with said edge.

8. The device of claim 1 wherein said hook is situated in a third plane, and wherein said third plane is situated between said first plane and second plane.

9. The device of claim 1 wherein said first plane and said second plane are substantially parallel to each other.

10. A device for hanging a package having a header from a display comprising a body having a top surface, a bottom surface, a first edge and a second edge space from each other, a hook extending from said top surface of said body and adapted to engage the display, a first member extending downwardly from said first edge of said body, second and third spaced members extending downwardly from said second edge of said body, wherein said first member is situated in a first plane, said second and third members are both situated in a second plane and wherein said first plane is spaced from and substantially parallel to said second plane, such that the header can be received between said first member and said second and third members.

11. The device of claim 10 wherein said first member is aligned with the space between said second and said third members.

12. The device if claim 10 further comprising engaging means associated with said first member.

13. The device of claim 12 wherein said engaging means comprises an inclined wall.

14. The device of claim 13 wherein said inclined wall extends from said first member.

15. The device of claim 13 wherein said inclined wall extends upwardly from said first member.

16. The device of claim 13 wherein said inclined wall extends away from said first member.

17. The device of claim 13 further comprising an opening in said first member.

18. The device of claim 17 wherein said inclined wall comprises an edge and wherein said edge of said inclined wall is aligned with said opening.

19. In combination, a package having a header and a device for hanging said package from a display comprising a body having a top surface, a bottom surface, a first edge and a second edge, a hook extending from said top surface of said body and adapted to engage the display, a first member extending downwardly from said first edge of said body, second and third members extending downwardly from said second edge of said body in spaced relation, wherein said first member is situated in a first plane, said second and third members are situated in a second plane and wherein said first plane is spaced from and substantially parallel to said second plane such that said header can be received between said members.

20. A device for hanging a package from a display, the package having a header, said device comprising a body having a top surface, a bottom surface, a first edge and a second edge, a hook extending from said top surface of said body and adapted to engage the display, a first member having a planar portion extending downwardly from said first edge of said body in a first plane, a second member having a planar portion and extending downwardly from said second edge of said body in a second plane, and further comprising a part extending from said first member portion toward said second member adapted to engage said header, wherein said part comprises an inclined wall, and wherein said inclined wall extends upwardly from said first member.

21. A device for hanging a package from a display, the package having a header, said device comprising a body having a top surface, a bottom surface, first edge and a second edge, a hook extending from said top surface of said body and adapted to engage the display, a first member extending downwardly from said first edge of said body in a first plane, a second member extending downwardly from said second edge of said body in a second plane, and further comprising a part extending from said first member toward the plane of said second member adapted to engage said header, wherein said engaging means part comprises an inclined wall, and a side element extending between said inclined wall and said first member.

22. A device for hanging a package from a display, the package having a header, said device comprising a body having a top surface, a bottom surface, a first edge and a second edge spaced from each other, a hook extending from said top surface of said body and adapted to engage the display, a first member extending downwardly from said first edge of said body in a first plane, a second member extending downwardly from said second edge of said body in a second plane, and further comprising a part extending from said first member toward the plane of said second member adapted to engage said header, and wherein said hook is situated in a third plane situated between said first plane and said second plane and parallel to said first plane and said second plane.

23. The device of claim 22 wherein said hook has an arcuate opening.

24. A device for hanging a package having a header from a display comprising a body having a top surface, a bottom surface, a first edge and a second edge, a hook extending from said top surface of said body and adapted to engage the display, a first member extending downwardly from said first edge of said body, second and third members extending downwardly from said second edge of said body, wherein said first member is situated in a first plane, said second and third members are situated in a second plane wherein said first plane is spaced from and substantially parallel to said second plane, such that the header can be received between said members and an engaging means associated with said first member, said engaging means comprises an inclined wall, further comprising an opening in said first member, wherein said inclined wall comprises an edge and wherein said edge of said inclined wall is aligned with said opening.

25. A device for hanging a package having a header from a display comprising a body having a top surface, a bottom surface, a first edge and a second edge, a hook extending from said top surface of said body and adapted to engage the display, a first member extending downwardly from said first edge of said body, second and third members extending downwardly from said second edge of said body, wherein said first member is situated in a first plane, said second and third members are situated in a second plane, wherein said first plane is spaced from and substantially parallel to said second plane, such that the header can be received between said members, an inclined wall associated with said first member, further comprising an opening in said first member, wherein said inclined wall comprises an edge and wherein said edge of said inclined wall is aligned with said opening.

26. A device for hanging a package from a display, the package having a header, said device comprising a body having a top surface, a bottom surface, a first edge and a second edge, a hook extending from said top surface of said body and adapted to engage the display, a first generally planar member extending downwardly from said first edge of said body in a first plane, a second generally planar member extending downwardly from said second edge of said body in a second plane, and further comprising a part extending from said first member toward said second plane adapted to engage said header between said first and second members, and wherein said part comprises an inclined wall and a side element extending between said inclined wall and said first member.

27. A device for hanging a package from a display, the package having a header, said device comprising a body having a top surface, a bottom surface, a first edge and a second edge, a hook extending from said top surface of said body and adapted to engage the display, a first generally planar member extending downwardly from said first edge of said body in a first plane, a second generally planar member extending downwardly from said second edge of said body in a second plane, and further comprising a part extending from said first member toward said second plane adapted to engage said header between said first and second members, and wherein said part comprises an inclined wall, further comprising an opening in said first member, wherein said inclined wall comprises an edge and wherein said edge of said inclined wall is aligned with said opening.

* * * * *